United States Patent [19]

Ustin

[11] 4,345,110

[45] Aug. 17, 1982

[54] SCREW-ON ELECTRICAL CONNECTOR

[76] Inventor: George Ustin, 16V Scenic Dr., Croton-on-Hudson, N.Y. 10520

[21] Appl. No.: 234,932

[22] Filed: Feb. 17, 1981

[51] Int. Cl.[3] ..... H01R 4/12

[52] U.S. Cl. ..... 174/87; 411/435

[58] Field of Search ..... 174/87; 411/435, 438; D13/26

[56] References Cited

U.S. PATENT DOCUMENTS 2,792,560 5/1957 Bollmeier ..... 174/87 X 2,959,995 11/1960 Linden ..... 174/87 X

*Primary Examiner*—Roy N. Envall, Jr.

*Attorney, Agent, or Firm*—Nicholas Noviello, Jr.

[57] ABSTRACT

A screw on electrical connector, commonly called a "pigtail," of a type which is generally made up of a tubular insulating cap closed at one end and open at the other end and a tapered helically wound resilient wire coil or spring nested and anchored in the cap, which is constructed and arranged to be screwed down on the stripped ends of two or more wires, and having one or more longitudinally extending levers, each of which is outwardly pivotally connected at one end thereof to the cap at or near the open end thereof. The levers are "L" shaped, each having an axially extending inwardly directed foot at one end thereof, and these feet are axially slidably connected to the cap at the closed end thereof. The cap may contain one or more inwardly directed recesses or channels, each keyed to a respective lever, so shaped and so disposed as to receive its respective lever. The levers may be outwardly pivotally connected to the cap by a resilient plastic means.

A method of making such a pigtail connector whereby the cap and lever or levers are cast in one piece, the area of joinder being a resilient plastic material. Each lever is pivoted, along the line of joinder with the cap, toward the closed end of the cap, and the foot end of each lever is axially slidably connected to the closed end of the cap.

7 Claims, 6 Drawing Figures

SCREW-ON ELECTRICAL CONNECTOR

BACKGROUND OF THE INVENTION

1. Field of the Invention

This invention is concerned with a screw-on electrical connector, of a type which is generally made up of a tubular insulating cap closed at one end and open at the other end containing a wire coil or spring and which is adapted to be turned down on the stripped ends of two or more wires.

More particularly, the present invention concerns a screw on connector having diagonally opposed longitudinally extending levers attached to the cap. Integrally formed on one end of each lever is an axially extending inwardly directed foot, the other end of the lever is plain. Each lever is outwardly pivotally connected at its plain end to the cap at or near the open end thereof. The foot of each lever is axially slidably connected to the cap at the closed end thereof.

Recesses or channels keyed to said levers may be provided in said cap, into which channels the respective levers may be pivoted. Or, if there are no channels, the levers may be folded against the body of the cap. Thus, the exterior bulk of the cap will be reduced, and the feet of the levers will comprise additional bulwarks against the stripped ends of the wires poking through the closed end of the cap.

2. Description of the Prior Art

Splice effectiveness is dependent on the amount of torque applied in turning the connector down on the stripped ends of the wires. The connectors should be as compact as possible because the space available in an outlet box is limited.

Torque requirements are high, for instance, in splicing several No. 12 solid conductors, some manufacturers furnish wrenches to apply more torque. Some connectors have "wings" or "ears" molded into their configurations to supply leverage. Some installers use pliers to increase torque and reduce fatigue. All of these methods have disadvantages. Special purpose wrenches are not always available. Wing or ear projections are space consuming. Pliers require additional labor time. In most cases an electrician will use his fingers to screw down a pigtail connector. The resultant connection is dependent upon his strength and integrity.

Prior art devices include a connector with a heavy skirt at the open end, with integral levers, fins or ears in fixed position on the skirt to provide additional leverage. This type of device is shown in U.S. Pat. No. 3,156,761 to Schinske, U.S. Pat. No. 3,001,002 to Schinske, U.S. Pat. No. 3,448,223 to Thorsman, U.S. Pat. No. 4,227,040 to Scott, U.S. Pat. No. 3,075,038 to Schinske, U.S. Pat. No. 3,113,553 to Schinske, U.S. Pat. No. 3,056,851 to Scott, U.S. Pat. No. 3,097,257 to Chency, U.S. Pat. No. 4,220,811 to Scott and U.S. Pat. No. 3,676,574 to Johansson. U.S. Pat. No. 3,297,816 to Waddington, U.S. Pat. No. 3,347,979 to Hoffman, U.S. Pat. No. 4,150,251 to Scott, and U.S. Pat. No. 3,902,005 to Norden show fixed fins or ribs longitudinally extending the length of the cap.

Thus, in this relatively crowded art, wherein fins, ears or levers have been attached to, or formed integrally as part of, the insulating cap, many specialized devices have evolved. However, no one has disclosed the use of levers, fins or ears pivotally connected to an insulating cap and which may be foled into or against the cap. Nor has there been any disclosure as to how one would proceed to accomplish such an objective with the heretofore known devices.

SUMMARY OF THE INVENTION

This is concerned with a screw-on electrical connector, commonly called a "pigtail," and more specifically is a connector of the type in which an insulating cap has an open end and a closed end and a generally open bore containing a wire coil or spring, and which is adapted to be screwed or turned down on the stripped ends of two or more wires.

A primary object of the invention is a connector of the above type having a cap having one or more longitudinally extending levers or fins which may be outwardly pivot for providing leverage for turning down the connector over the wires, said levers being outwardly pivotally attached to the cap at or near the open end thereof and axially slideably connected to said cap at the closed end thereof.

Another object is to provide a connector of the above type having a recess or channel for each such lever, each such channel being so shaped and so disposed that its respective lever may be pivoted into it and be completely contained therein, thus reducing the exterior bulk of the connector.

Another object is to provide a connector of the above type in which each lever is "L" shaped, so that the connector may be hung or suspended by any one lever, as from a nail or screw.

Another object is to provide a connector of the above type in which each lever is pivotally connected to the cap by a resilient plastic means.

Another object is to provide a connector of the above type wherein the levers, in closed position, provide additional bulwarks at the closed end of the cap against the bared ends of the wires poking through the closed end of the cap.

Other objects will appear from time to time in the ensuring specifications and drawings.

BRIEF DESCRIPTION OF THE DRAWINGS

For a fuller understanding of the invention, reference is made to the detailed description thereof in conjunction with the drawings which are as follows.

DESCRIPTION OF THE PREFERRED EMBODIMENT

Figure 1:
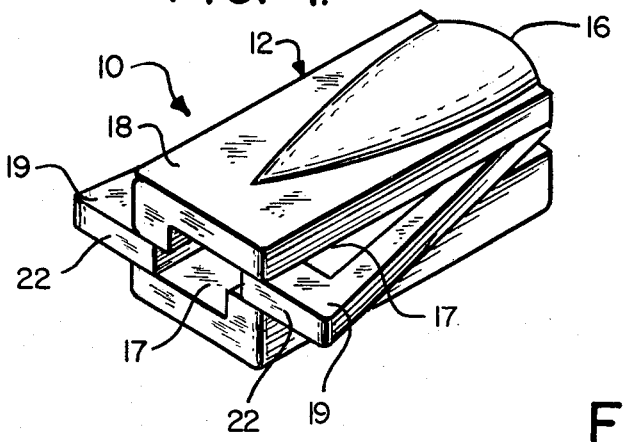
FIG. 1 is a perspective view from the closed end of the connector, with the levers in outwardly extended position.
Figure 2:
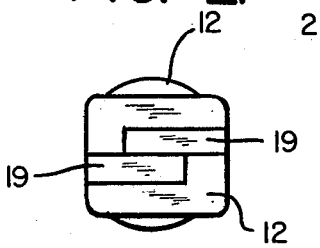
FIG. 2 is a view of the closed end, showing the levers in closed position.
Figure 3:
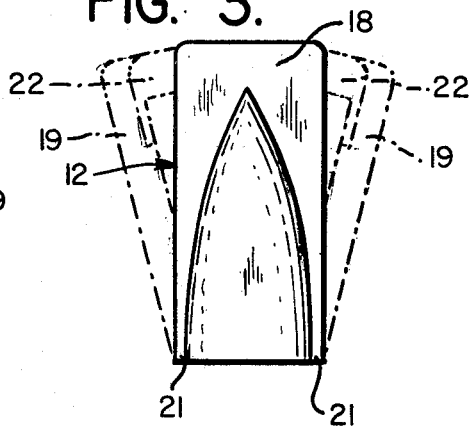
FIG. 3 is front view, showing the levers in outwardly extended position.
Figure 4:
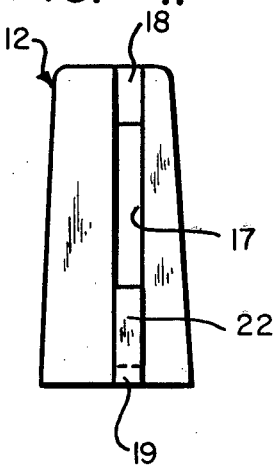
FIG. 4 is a side view showing the levers in closed position.
Figure 5:
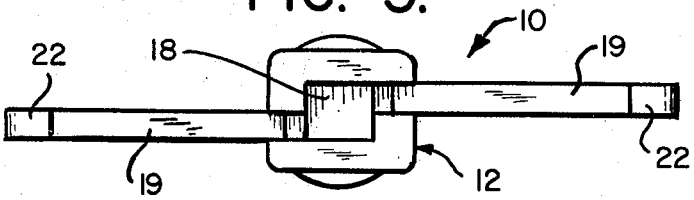
FIG. 5 is a view of the closed end with the levers extended flat out, showing the cap as made in one piece.
Figure 6:
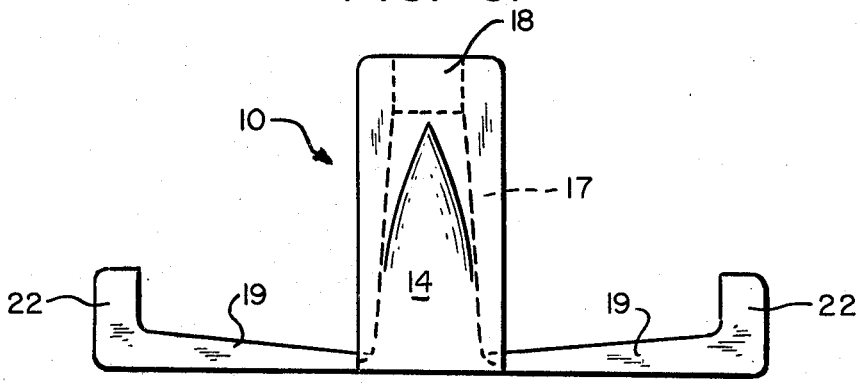
FIG. 6 is a longitudinal sectional front view, with the levers extended flat out, showing the cap as made in one piece.

In the figures, a connector, indicated generally at 10, is shown, which includes an outer shell or cap 12 made of an insulating material and having a generally open central bore 14 which is open at one end 16, and closed at the other by an end wall 18. Two longitudinally extending levers 19, diametrically opposite one another, each having a plain end 21 and a foot end 22 integrally formed into an axially extending and inwardly directed foot, are outwardly pivotally attached at their plain ends 21 to the cap 12 at its open end 16, and are axially slidably attached at their foot ends 22 to the cap 12 at its end wall 18. The cap 12 contains inwardly directed and longitudinally extended recesses or channels 17 respectively keyed to the levers 19, so shaped and so disposed that each lever 19 may be pivoted or folded completely into its respective channel 17. The levers 19 may be outwardly pivotally connected to the cap 12 by resilient hinges or by a resilient plastic means 21.

In outwardly extended position, a portion of the foot end 22 of each lever 19 remains snugly inserted in its respective channel 17. In this position, the levers 19 provide leverage for turning the connector 10 down on the wires.

In closed position, each lever 19 is completely recessed into its respective channel 17 and the foot end 22 of each lever 19 lies snugly against the end wall 18 of the cap 12. Thus the exterior bulk of the connector 10 is reduced and the foot ends 22 of the levers 19 provide additional bulwarks against the wire ends poking through the end wall 18 of the cap 12. When a lever 19 is in outward extended position, the connector 10 may be hung or suspended by the foot end 22 of the lever 19, as by a nail, screw or hook. This may be desirable for temporarily hanging wires during an installation operation.

What is claimed is:

1. In an electrical connector of the screw-on type for joining the ends of two or more electric wires, a cap of stiffly flexible insulating material having a generally central bore open at one end and closed at the other end by an integral end wall, a generally L-shaped longitudinally extending lever having a plain end and a foot end having an integral axially extending and inwardly directed extension, said lever being outwardly pivotally connected at its plain end to said cap at or near said open end thereof and said foot end of said lever being axially slidably connected to said cap at said end wall thereof, and said cap having an inwardly directed longitudinally extending channel, keyed to said lever and so shaped and so disposed as to receive and contain said lever, whereby said lever may be pivoted to a position partially out of said channel, thereby providing leverage for turning said connector down on said wires, and whereby said lever may be pivoted into said channel, in which position said foot end of said lever will lie snugly against said end wall of said cap, thus providing a bulwark against said ends of said wires poking through said connector.

2. The structure of claim 1 further characterized in that said cap has a second lever and a second channel, disposed diametrically opposite said lever and said channel mentioned in said claim 1 and so keyed, shaped and arranged as to function in the same manner as said lever and said channel of said claim 1.

3. In an electrical connector of the screw-on type for joining the ends of two or more electrical wires, a cap of stiffly flexible insulating material having a generally central bore open at one end and closed at the other end by an integral end wall, a generally L-shaped longitudinally extending lever having a plain end and a foot end having an integral axially extending and inwardly directed extension, said lever being outwardly pivotally connected at its plain end to said cap at or near said open end thereof, and said foot end of said lever being axially slidably connected to said cap at said end wall thereof, whereby said lever may be pivoted to a position outward from said cap, thereby providing leverage for turning said connector down on said wires, and whereby said lever may be pivoted to a position snugly against said cap with said foot end of said lever disposed snugly against said end wall of said cap, said foot end of said cap thereby providing a bulwark against said ends of said wires poking through said connector.

4. The structure of claim 3 further characterized in that said cap has a second lever, disposed diamatrically opposite said lever mentioned in said claim 3, and so disposed, shaped and arranged as to function in the same manner as said lever of said claim 3.

5. The structure of claim 3 further characterized in that said lever is pivotally connected to said cap by a flexible plastic means.

6. The method of making an insulating cap for an electrical connector for use in joining a plurality of wire ends, comprising the steps of: forming in one piece a cap having a generally central core open at one end and closed at the other end and an "L" shaped lever extending outwardly from said cap and pivotally attached thereto at or near the open end thereof, said lever having a foot inwardly directed toward said cap, pivoting said lever along the line of joinder with said cap toward the closed end of said cap, and axially slidably connecting said foot of said lever to said closed end of said cap.

7. The method of claim 6 further characterized in that said lever is connected to said cap by a resilient plastic means.

* * * * *